US008276871B1

(12) United States Patent
DeRienzo

(10) Patent No.: US 8,276,871 B1
(45) Date of Patent: Oct. 2, 2012

(54) UNIVERSAL TURNTABLE FOR CHRISTMAS TREE STANDS

(76) Inventor: Vincent James DeRienzo, Hackettstown, NJ (US)

( * ) Notice: Subject to any disclaimer, the term of this patent is extended or adjusted under 35 U.S.C. 154(b) by 268 days.

(21) Appl. No.: 12/687,731

(22) Filed: Jan. 14, 2010

(51) Int. Cl.
*A47B 95/00* (2006.01)
*A47G 33/12* (2006.01)

(52) U.S. Cl. ..... 248/521; 248/349.1; 47/40.5

(58) Field of Classification Search ..... 248/349.1, 248/131, 519, 523, 521, 447, 451, 457, 458, 248/165; 40/39, 40.5, 65; 211/78–81, 71.01
See application file for complete search history.

(56) References Cited

U.S. PATENT DOCUMENTS

| | | | | |
|---|---|---|---|---|
| 559,161 | A | 4/1896 | Brower | |
| 3,302,594 | A | 2/1967 | Barnett et al. | |
| 3,652,972 | A | 3/1972 | Kreider | |
| 4,117,627 | A | 10/1978 | Slingerland, Jr. | |
| 4,895,339 | A | 1/1990 | Yang et al. | |
| 5,492,301 | A | 2/1996 | Hauser | |
| 5,779,309 | A * | 7/1998 | Lu | 248/349.1 |
| 5,893,547 | A * | 4/1999 | Cohen, Jr. | 248/521 |
| 5,921,022 | A * | 7/1999 | Baker | 47/40.5 |
| 6,102,357 | A | 8/2000 | Papadatos | |
| 6,572,064 | B1 * | 6/2003 | Letson et al. | 248/349.1 |
| 6,854,608 | B2 * | 2/2005 | McNeeley et al. | 211/78 |
| 7,021,598 | B2 * | 4/2006 | Kao | 248/521 |
| 7,028,968 | B2 | 4/2006 | Washick | |
| 7,314,203 | B2 * | 1/2008 | Yue | 248/349.1 |

FOREIGN PATENT DOCUMENTS

| | | |
|---|---|---|
| WO | WO97/38615 | 10/1997 |
| WO | WO2008/122995 | 10/2008 |

* cited by examiner

*Primary Examiner* — Tan Le
(74) *Attorney, Agent, or Firm* — Michael I. Kroll

(57) ABSTRACT

A method of rotatively displaying a Christmas tree with a universal display stand turntable having a stationary base, a rotatable platform having a plurality of concentric annular steps, each step having a bottom portion, a wall portion and a frictional surface on the bottom portion of the steps, and a ball bearing raceway rotatably connecting the base and the platform. The view of the Christmas tree can be adjusted by placing a Christmas tree display stand in the platform, resting on one of the steps, affixing a Christmas tree to the stand, and rotating the platform to display the Christmas tree as desired.

9 Claims, 6 Drawing Sheets

UNIVERSAL TURNTABLE FOR CHRISTMAS TREE STANDS

BACKGROUND OF THE INVENTION

1. Field of the Invention

The present invention relates generally to tree stands and, more specifically, to a universal display stand turntable for Christmas tree stands comprising a base portion and a platform portion with a ball bearing raceway therebetween whereby the platform portion is rotatable relative to the stationary base portion.

The base portion has an aperture for receiving the ball bearing raceway and platform with a flange having a plurality of throughbore apertures whereby fasteners can be inserted through the base securing said base to structure such as a plywood sheet.

The platform portion has a plurality of stepped annular apertures for placement therein of varying sized tree stands with each stepped annular aperture comprised of a platform portion and a walled portion forming support and containment for a Christmas tree stand from radial displacement once placed therein. The present invention further provides for notches within the stepped platform portions for receiving the footpads of Christmas tree stands having legs. Further provided are a plurality of apertures depending into said stepped platform portion with mating pins/fasteners for insertion through Christmas tree stand footpad apertures for securing said Christmas tree stands legs to said stepped platform portions.

2. Description of the Prior Art

There are other turntable device designed for support. Typical of these is U.S. Pat. No. 559,161 issued to Brower on Apr. 28, 1896.

Another patent was issued to Barnett et al on Feb. 7, 1967 as U.S. Pat. No. 3,302,594. Yet another U.S. Pat. No. 3,652,972 was issued to Kreider on Mar. 28, 1972 and still yet another was issued on Oct. 3, 1978 to Slingerland, Jr. as U.S. Pat. No. 4,117,627.

Another patent was issued to Yang et al on Jan. 23, 1990 as U.S. Pat. No. 4,895,339. Yet another U.S. Pat. No. 5,492,301 was issued to Hauser on Feb. 20, 1996. Another was issued to Cohen, Jr. on Apr. 13, 1999 as U.S. Pat. No. 5,893,547 and still yet another was issued on Aug. 15, 2000 to Papadatos as U.S. Pat. No. 6,102,357.

Another patent was issued to Letson et al on Jun. 3, 2003 as U.S. Pat. No. 6,572,064. Yet another U.S. Pat. No. 7,028,968 was issued to Washick on Apr. 18, 2006. Another was issued to Krinner on Oct. 23, 1997 as International Patent Application Publication No. WO97/38615 and still yet another was issued on Oct. 16, 2008 to Mann as International Patent Application Publication No. WO2008/122995.

The combination with a bookcase or the like and a supporting-base upon which the case is mounted to revolve, of a loosely-journaled holder oscillating horizontally between the base and case and provided with a plurality of openings each provided with a ball loose within the opening and disconnected from the holder, said balls forming bearings for the case and base, substantially as described.

A turntable which includes, in combination, a platform being planar throughout a substantial portion thereof the planar portion having a top to receive a deposited article and a bottom, a plurality of spaced mounting members fixed to the bottom of the platform, each mounting member having an arcuate flange portion, each arcuate flange portion being substantially parallel to the bottom of the platform, a lower stationary annular raceway member, said raceway member having a circumferential line within the substantially planar portion of the platform, said annular raceway having a bottom adapted to contact a supporting base, continuous walls on the inner and outer annular edges of the bottom extending towards the platform bottom, a continuous raceway flange at the top of the outer annular wall of the raceway, said flange positioned above the arcuate flange portions of the mounting members so the position of the annular raceway is defined by the mounting members, a continuous roller retainer ring in the raceway, said ring dimensioned to fit in the raceway portion formed by the bottom of the raceway and the inner and outer annular walls, and a plurality of roller bearing means confined within the ring at spaced positions, whereby the platform is adapted to be rotated upon the roller bearing means rotatably confined within the ring and within the raceway which is stationarily positioned on the support base.

A turntable device for supporting a plurality of household appliances and including electrical plug receptacles maintained in a continuous state of energization during rotational movement of the device.

A freely rotatable, effectively tilt-free stand for carrying plants and the like. The stand includes a plurality of relatively rotatable members cooperatively defining a ball bearing structure wherein the ball bearings are disposed in an annular array at the periphery of the assembly so as to provide an effectively tilt-free rotation thereof. Support of the structure relative to the bearings is effected by metallic bearing plates which may be adhesively secured to other elements of the structure. The base member may have a lateral extent substantially greater than that of the rotatable portions to provide further tilt-free stability.

It is a detachable swivelling structure, which is particular a swivelling structure for mounting a swivelling Christmas tree. The swivelling structure comprises a round base, four supporting legs to be assembled at a perpendicular angle one another or disassembled, a lid, and a turning base. After the four supporting legs being assembled together, they are mounted under the round base so as to have a larger base to hold the swivelling tree in a stable manner.

A Christmas tree stand which is characterized by a base for resting on a supporting surface, a ball assembly swivally secured to the base in universally-pivoting relationship by means of a fixed socket bracket and a cooperating movable socket bracket and a mount cup secured to the ball assembly for receiving and mounting the trunk of a Christmas tree. The mount cup and ball assembly are designed to pivot and swivel in a 360-degree rotation to orient the tree in a vertical position regardless of the configuration of the trunk. In a preferred embodiment accessory leg extensions are adjustably slidably extendable from the base for further stabilizing the Christmas tree stand.

A two-part stand assembly, preferably for the indoor display of natural Christmas trees or the like, is described. The upper part of the stand, which holds the tree, rotates clockwise and counterclockwise around the stationary lower part of the stand. The stand assembly comprises: (a) a removable upper pot portion comprising a bucket of sufficient dimension to accommodate the Christmas tree or other pole-like member, and releaseable fastening means for holding the Christmas tree or other pole-like member in an upright position; (b) a rotatable ring member comprising a channel and one or more concentric rings, the channel holding a plurality of ball bearings; and 8 a lower base portion comprising a central well for surrounding and receiving a portion of the bucket of the upper pot portion, and a flat base capable of supporting the stand assembly and Christmas tree on a horizontal surface; and wherein the removeable upper pot portion fits over the rotatable ring member such that the upper pot portion is capable of rotating while the lower base portion remains stationary.

A versatile and adjustable stand having a base, a receptacle attached to the base via a ball and socket joint, and a plurality of horizontally and vertically adjustable legs. The stand also includes a locking device which fixes the angular position of the ball portion of the ball and socket joint, and various spring biasing mechanisms which allow for vertical and horizontal adjustability of the legs.

A revolving tree stand having a bucket into which the terminating end of a tree's trunk is inserted whereby a spike in the bucket retains the trunk in the bucket. Securement near the top of the bucket adjustably supports the tree in an upright and straight position. The bucket holds a quantity of water and a float indicator is employed for visually indicating water level. The bucket is rotatably mounted on a stationary support which incorporates roller bearings on which the bottom of the bucket rests. Therefore, rotation of the tree via the bucket is achieved by the bearings at the bottom of the bucket and, if desired, bearings at the top of the bucket. A stop may adjustably retain the bucket in a releasable fixed position, A rotating movable tree stand comprising a base providing a movable platform, an upper portion rotatably mounted to the base, and at least one mount removably coupled to the upper portion and configured to clamp a tree stand to the upper portion. An upper portion may comprise a plurality of slots in an annual arrangement in which the mounts may be engaged for clamping.

A Christmas tree stand has a stand body (2) with a vertical axis (A), a locating aperture (42) in the stand body through which the vertical axis (A) passes and in which the trunk of a Christmas tree can be clamped essentially parallel to the vertical axis (A), and at least two essentially horizontal clamping arms (18, 20) that delimit the locating aperture (42) and enable the clear span of the locating aperture (42) to be adjusted and that are applied to the trunk of the Christmas tree under pressure. At one of their ends the clamping arms (18, 20) are pivotably mounted on the stand body (2) to swing in an essentially horizontal plane and at their other, free ends are acted upon by a joint clamping device, which, basically in the form of a threaded rod (26) with two counter-rotating threaded sections (32, 34), remains stationary vis-à-vis the stand body (2). As a result, the span of the locating aperture (42) defined by the two clamping arms (18, 20) can be altered horizontally in relation to the stand body (2), thus providing a better adjustment for Christmas tree trunks that are markedly unround, that have grown at a slant or are otherwise difficult to clamp.

A re-turning plant (1) for rollers (7) of rolling mills of the type comprising at least one roller stand (1) and a plurality of rollers (7) mounted to respective arms (6) pivoting in the plane of the roller stand (1) about respective pins (8) that are fixed to the roller stand (1), the rollers (7) being positioned within the roller stand (1) in a work position in which work surfaces (9) of the rollers (7) determine the outer profile of a body to be rolled, wherein the re-turning plant (1) comprises a support structure (12) configured to support the whole roller stand (1) in a turning position, a tool-holding device (13) that can be displaced in contact with the work surfaces (9) of each roller (7) of the plurality of rollers (7) fixed in the roller stand (1) and mandrel means (14) with means (15, 16) that can be rotatably coupled to each roller (7) of the plurality of rollers (7); fixed to the roller stand (1) to rotate the same substantially in the work position.

While these turntables may be suitable for the purposes for which they were designed, they would not be as suitable for the purposes of the present invention, as hereinafter described.

SUMMARY OF THE PRESENT INVENTION

A primary object of the present invention is to provide a universal display stand turntable stand for Christmas tree stands.

Another object of the present invention is to provide a universal Christmas tree stand that has a portion that is selectively rotatable through 360 degrees.

Yet another object of the present invention is to provide a universal Christmas tree stand having a base portion and a platform portion with a ball bearing raceway therebetween providing a free wheeling platform for mounting a Christmas tree stand thereon.

Still yet another object of the present invention is to provide a universal Christmas tree stand wherein said base has a flange with a plurality of through bore apertures for selectively receiving fasteners whereby said Christmas tree stand can be secured to structure.

Another object of the present invention is to provide a universal Christmas tree stand wherein said platform is annularly stepped for receiving various sizes of Christmas tree stands.

Yet another object of the present invention is to provide a universal Christmas tree stand where each step has a base portion and a wall portion forming support and containment from radial displacement as the platform portion is rotated.

Still yet another object of the present invention is to provide a Christmas tree stand wherein each of said step base portions has a plurality of radially extending notches for receiving the footpads of Christmas tree stands having legs.

An additional object of the present invention is to provide a universal Christmas tree stand having depending cavities within each of said step base portions whereby pins/fasteners can be inserted through coaligned apertures within at least one footpad of a Christmas tree stand leg.

Additional objects of the present invention will appear as the description proceeds.

The present invention overcomes the shortcomings of the prior art by providing a universal display stand turntable for Christmas tree stands comprising a base portion and a platform portion with a ball bearing raceway therein between whereby said platform portion is rotatable relative to said base portion. The base portion has an aperture for receiving the ball bearing raceway and platform with a flange having a plurality of throughbore apertures whereby fasteners can be inserted through the base securing said base to structure such as a plywood sheet. The platform portion has a plurality of stepped annular apertures for placement therein of varying sized tree stands with each stepped annular aperture comprised of a platform portion and a walled portion forming support and containment for a Christmas tree stand from radial displacement once placed therein. The present invention further provides for notches within the stepped platform portions for receiving the footpads of Christmas tree stands having legs. Further provided are a plurality of apertures depending into said stepped platform portion with mating pins/fasteners for insertion through Christmas tree stand footpad apertures for securing said Christmas tree stands legs to said stepped platform portions.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is a universal display stand turntable for Christmas tree stands.

FIG. 2 an illustrated view of Christmas tree stands.

Figure 5:
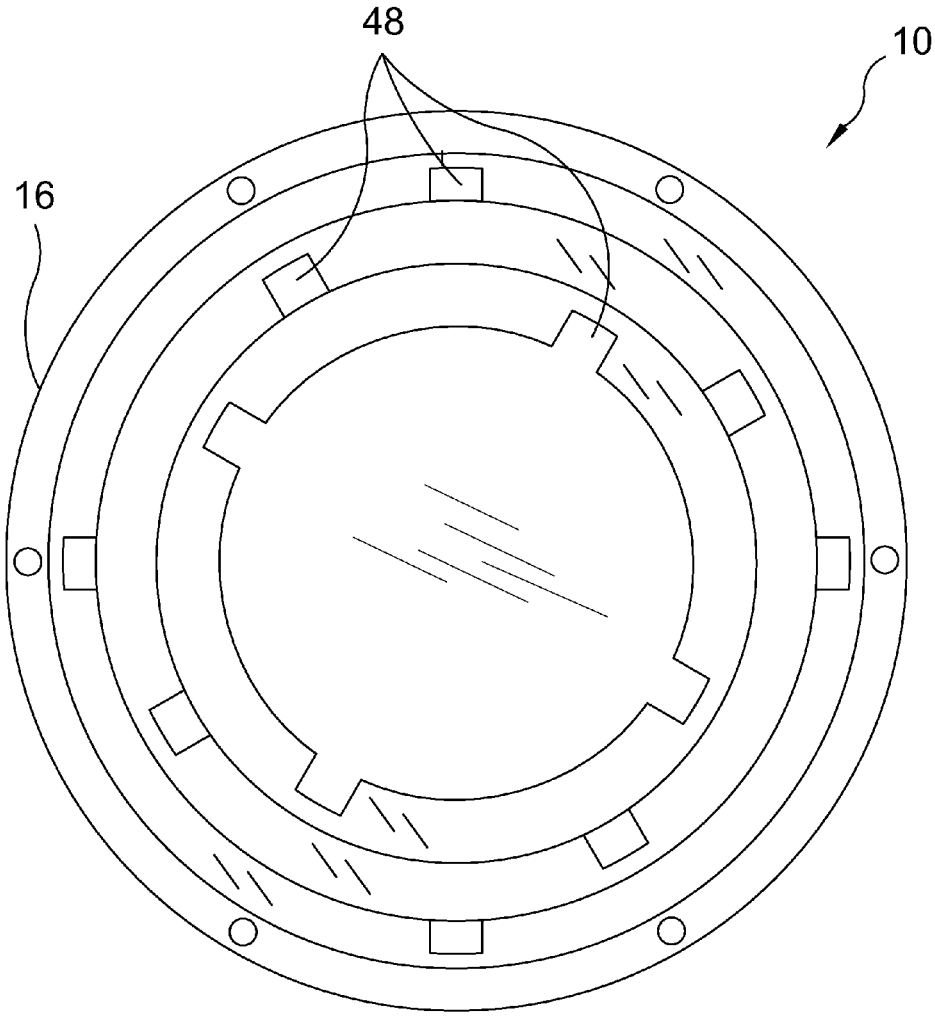

FIG. 5 a top plan view of the universal display stand turntable for Christmas tree stands of the present invention.

Figure 6:
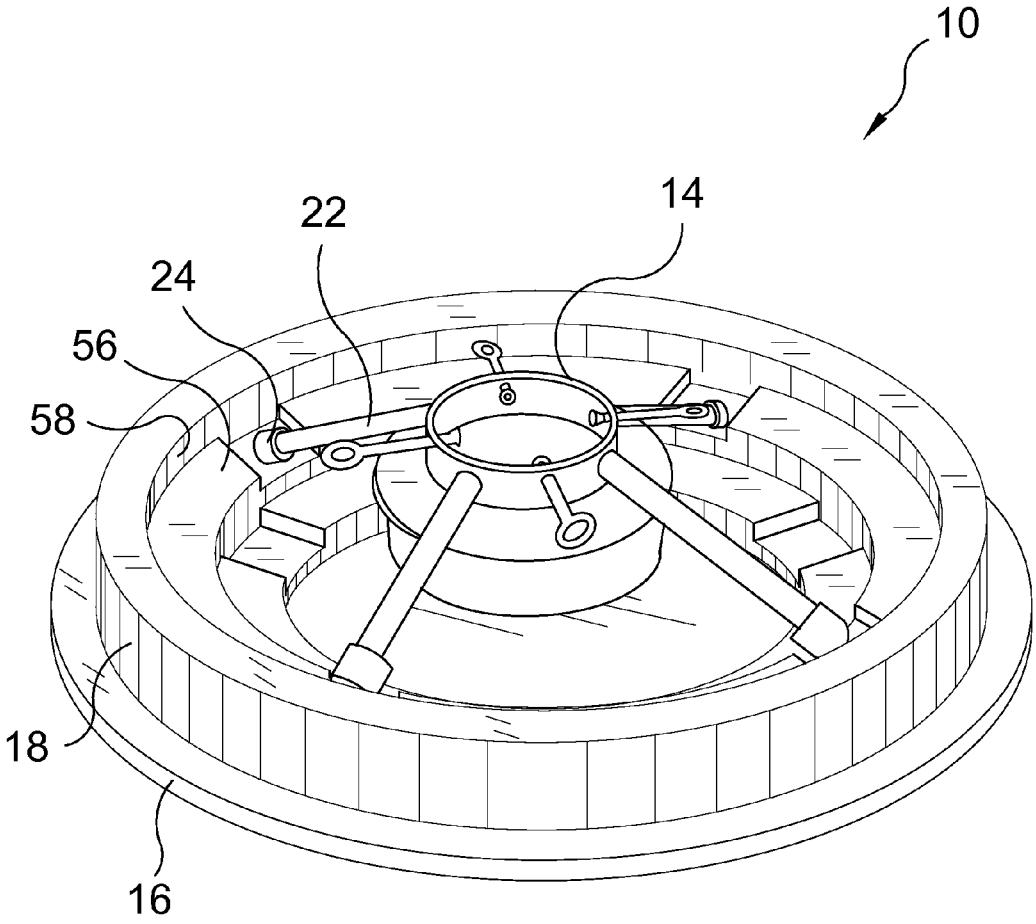

FIG. 6 is an illustrated view of a Christmas tree stand having legs positioned within the universal display stand turntable Christmas tree stand of the present invention.

DESCRIPTION OF THE REFERENCED NUMERALS

Turning now descriptively to the drawings, in which similar reference characters denote similar elements throughout the several views, the figures illustrate the Universal Display Stand Turntable of the present invention. With regard to the reference numerals used, the following numbering is used throughout the various drawing figures.

| | |
|---|---|
| 10 | Universal Display Stand Turntable |
| 12 | Christmas tree display |
| 14 | Christmas tree display stand |
| 16 | base of 10 |
| 18 | platform of 10 |
| 20 | annular steps in 18 |
| 22 | leg of 14 |
| 24 | footpad of 22 |
| 26 | aperture through 24 |
| 28 | base of 14 |
| 30 | small annular step |
| 32 | medium annular step |
| 34 | large annular step |
| 36 | small tree display stand |
| 38 | medium tree display stand |
| 40 | large tree display stand |
| 42 | ball bearing raceway connecting 16 and 18 |
| 44 | friction surfaces on steps |
| 46 | plywood sheet fastened to 16 |
| 48 | radial notches in 20 |
| 50 | flange on 16 |
| 52 | bore in 50 |
| 54 | fastener through 52 |
| 56 | bottom of 20 |
| 58 | wall portion of 20 |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
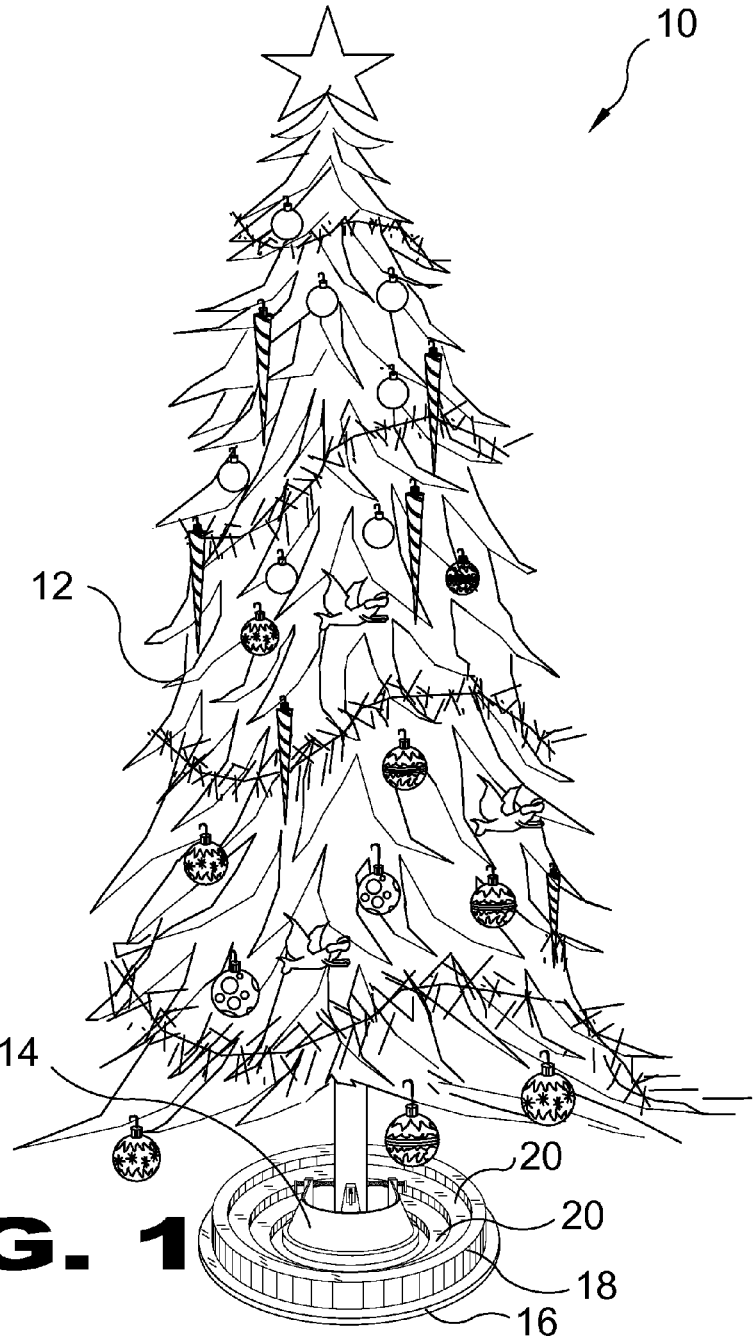

FIG. 1 is a universal display stand turntable for Christmas tree stands. The present invention 10 provides a mount for a Christmas tree 12 mounted to a Christmas tree display stand 14 that is rotatable selectively through 360 degrees. The invention has a stationary base 16 to which is mounted a platform 18 which rotatively supports the Christmas tree display stand 14. The platform 18 has concentric annular steps 20 of varying diameters for receiving Christmas tree stands 14 of varying diameters. The universal display stand turntable 10 of the present invention is particularly suitable for displaying Christmas trees 12 in Christmas tree stands 14 and provides means for a user to stand in one location while decorating the tree and move the tree instead of moving themselves around the tree. It further provides that once decorated the tree can be rotated to an aesthetically desired viewing position.

Figure 2:
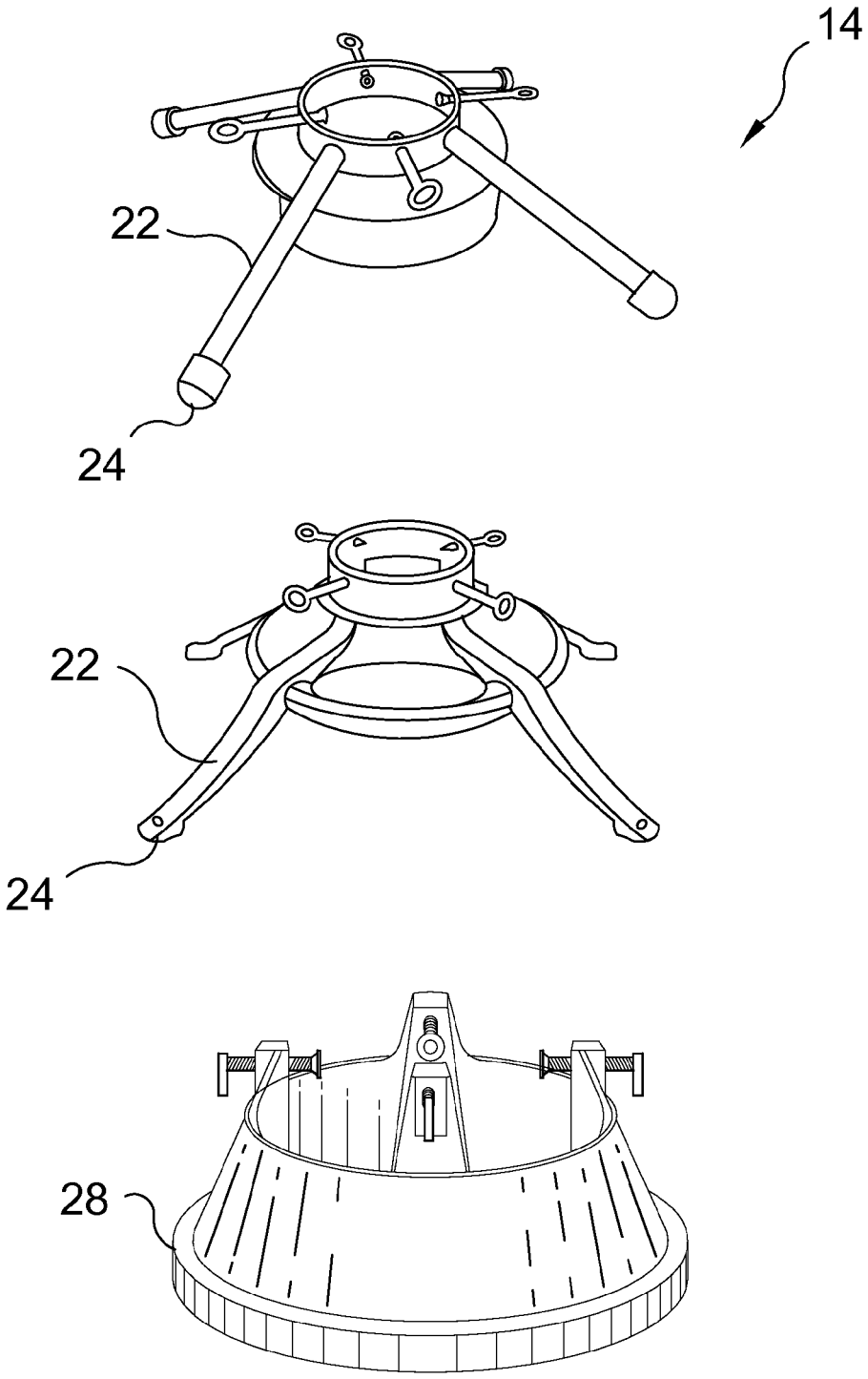

FIG. 2 an illustrated view of Christmas tree stands 14. Christmas tree stands 14 are typically found as stands having a plurality of legs 22 terminating in distal footpads 24, which may or may not have apertures 26 passing therethrough. Other common styles of Christmas tree stand include those having a flat base 28, which is conventionally circular. The present invention provides a turntable stand with a plurality of progressively smaller steps for placement therein of an appropriate stand 14.

Figure 3:
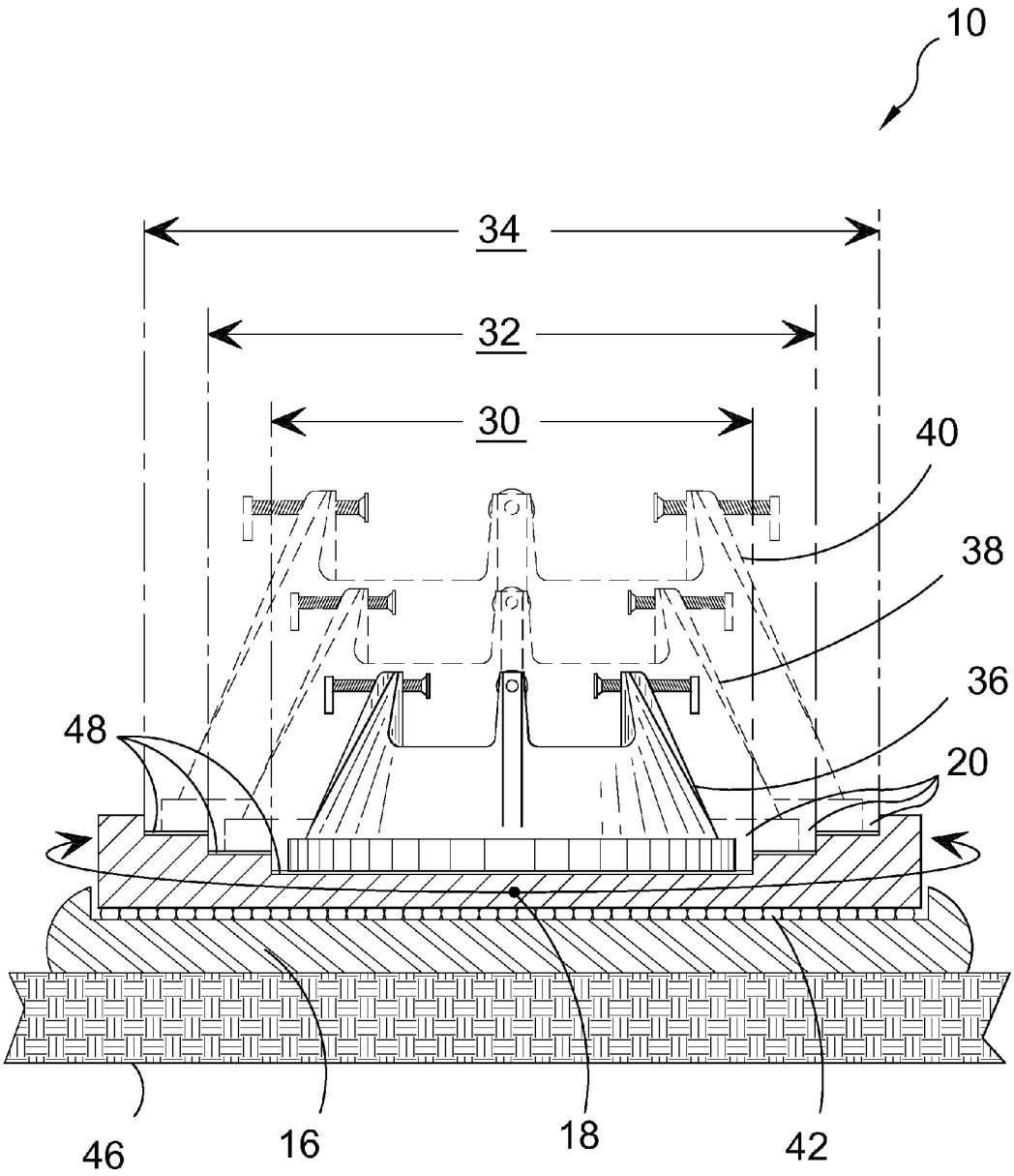
FIG. 3 is a sectional view of the universal display stand turntable for Christmas tree stands of the present invention.

FIG. 3 is a sectional view of the universal display stand turntable 10 of the present invention. The platform 18 has a plurality of annular steps 20 for receiving stands 14 of varying diameters. The present invention provides a mount for a Christmas tree that is rotatable through 360 degrees. The turntable mount has annular steps of varying diameters for receiving Christmas tree stands of varying diameters. Illustrated are a small sized annular step 30, a medium sized annular step 32 and a large sized annular step 34, which are sized to accommodate small sized tree display stands 36, medium sized tree display stands 38 and large sized tree display stands 40.

The present invention provides a universal display stand turntable 10 for Christmas tree stands 14 comprising a base 16 and a platform 18 with a ball bearing raceway 42 therebetween connects the base 16 and the platform 18 whereby the platform 18 is rotatable relative to the stationary base 16.

Figure 4:
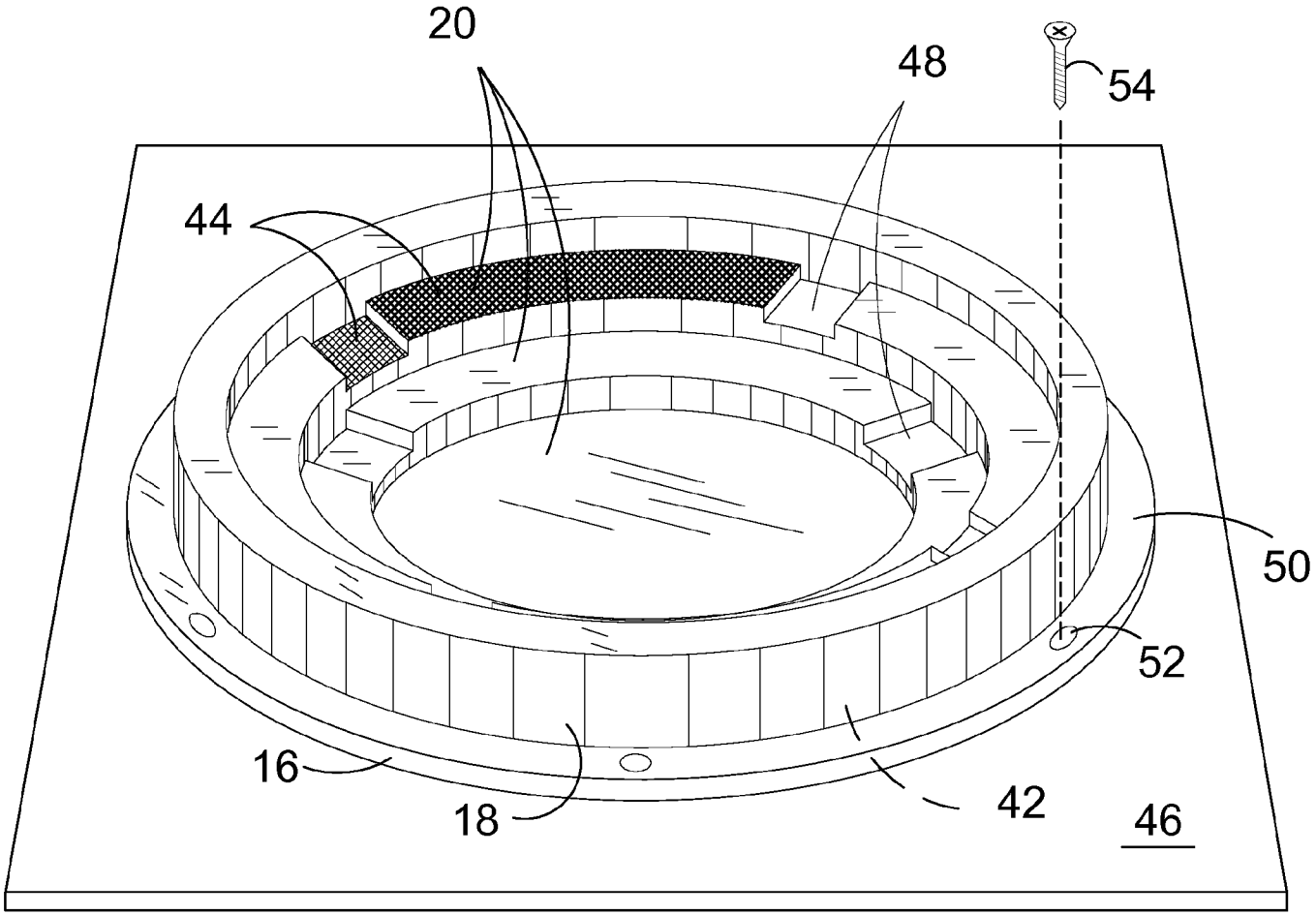
FIG. 4 is a perspective view of the universal display stand turntable for Christmas tree stands of the present invention.

FIG. 4 is a perspective view of the universal display stand turntable 10 for Christmas tree stands of the present invention. Shown is the universal display stand turntable 10 for Christmas tree stands comprising a base 16 and a platform 18 with a ball bearing raceway 42 therebetween whereby the platform 18 is rotatable relative to the base 16. Also shown are a plurality of steps 20 for receiving stands of varying diameters. The universal display stand turntable 10 further provides radial notches 48 within the steps for receiving the footpad of Christmas tree stands having legs. Also shown are the base 16 having an perimeter flange 50 having one or more bores 52 therethrough, through which a fastener 54, for example a screw, bolt or pin, can affix the base 16 to a support surface. The present invention optionally includes a frictional surface 44 on the bottom surface of the steps. Also shown is a support surface 46, for example, a plywood subsurface, to which the base 16 can be affixed.

FIG. 5 is a top plan view of the universal display stand turntable 10 for Christmas tree stands of the present invention. Shown is the universal display stand turntable 10 for Christmas tree stands comprising a base 16 and a platform with steps for receiving stands of varying diameters. Illustrated are radial notches 48 within the steps for receiving the footpad of Christmas tree stands having legs.

FIG. 6 is an illustrated view of a Christmas tree stand 14 having legs 22 terminating in distal footpads 24 positioned within the universal display stand turntable 10 of the present invention. Shown is the universal display stand turntable 10 having a Christmas tree stand 14 with legs 22 positioned therein. The universal display stand turntable 10 provides annular steps of varying diameters to accommodate either Christmas tree stands having a flat base or stands with legs 22. The steps each have a bottom portion 56 and a wall portion 58 with the bottom portion 56 supporting the base of the display stand 14 while the wall portion 58 prevents radial displacement of the stand 14 once placed within the platform 18.

The invention claimed is:

1. A universal display stand turntable comprising:

a) a stationary base;

b) a rotatable platform having a plurality of concentric annular steps, each said step having a bottom portion and a wall portion; and c) a ball bearing raceway rotatably connecting said base and said platform;

d) a plurality of radially extending notches in each of said bottom portions of said steps;

e) a frictional surface on said bottom portion of said steps, and a flange having a plurality of bores therethrough on said base; and f) a plurality of apertures through said bottom of said notches in said steps, and a plurality of pins sized to be received within said apertures in said steps.

2. The universal display stand turntable of claim 1, wherein said platform is selectively rotatable through 360 degrees.

3. The universal display stand turntable of claim 2, wherein said platform comprises small, medium and large concentric annular steps.

4. A method of displaying a Christmas tree comprising the steps:

a) providing a universal display stand turntable having a stationary base;

b) a rotatable platform having a plurality of concentric annular steps, each said step having a bottom portion, a wall portion and a frictional surface on said bottom portion of said steps; and c) a ball bearing raceway rotatably connecting said base and said platform;

d) placing a Christmas tree display stand in said platform, resting on one of said steps;

e) affixing a Christmas tree to said Christmas tree display stand;

f) rotating said platform to display the Christmas tree as desired; and g) securing the Christmas tree stand to the platform with a plurality of apertures through said platform in said steps and a plurality of securing pins adapted to be received within said apertures.

5. The method of claim 4, further comprising the step of securing the base to a support structure with a flange having a plurality of bores therethrough on said base.

6. The method of claim 5, wherein:

a) said steps include a plurality of spaced notches in said bottom portion; and b) said Christmas tree stand include a plurality of legs having distal footpads sized and spaced to reside with said notches; and c) said footpads are placed within said notches.

7. The method of claim 6, further comprising the step of securing said footpads within said notches with said securing pins.

8. A universal display stand turntable comprising:

a) a stationary base;

b) a rotatable platform having a plurality of concentric annular steps, each said step having a bottom portion and a wall portion;

c) a ball bearing raceway rotatably connecting said base and said platform;

d) a plurality of radially extending notches in each of said bottom portions of said steps; and e) a Christmas tree stand sized to be received within one of said plurality of steps, said Christmas tree stand having a plurality of legs with distal footpads sized and spaced to be received within said notches.

9. The universal display stand turntable of claim 8, further comprising:

a) a plurality of apertures through said platform in said steps; and b) a plurality of securing pins adapted to be received within said apertures.

* * * * *